US009527306B2

(12) United States Patent
Ohnishi et al.

(10) Patent No.: US 9,527,306 B2
(45) Date of Patent: Dec. 27, 2016

(54) INKJET PRINTER AND PRINTING METHOD

(75) Inventors: Masaru Ohnishi, Nagano (JP); Kazuhide Yokoyama, Nagano (JP)

(73) Assignee: MIMAKI ENGINEERING COMPANY, LTD., Nagano (JP)

( * ) Notice: Subject to any disclaimer, the term of this patent is extended or adjusted under 35 U.S.C. 154(b) by 0 days.

(21) Appl. No.: 13/393,694

(22) PCT Filed: Sep. 2, 2010

(86) PCT No.: PCT/JP2010/005409

§ 371 (c)(1),
(2), (4) Date: Jun. 19, 2012

(87) PCT Pub. No.: WO2011/027560

PCT Pub. Date: Mar. 10, 2011

(65) Prior Publication Data

US 2012/0262526 A1 Oct. 18, 2012

(30) Foreign Application Priority Data

Sep. 2, 2009 (JP) ..... 2009-202268

(51) Int. Cl.
*B41J 3/407* (2006.01)
*B41J 2/105* (2006.01)
(Continued)

(52) U.S. Cl.
CPC ..... *B41J 3/4078* (2013.01); *B41J 2/105* (2013.01); *B41J 11/06* (2013.01); *D06B 1/142* (2013.01); *D06P 5/30* (2013.01); *B41J 2202/02* (2013.01)

(58) Field of Classification Search
USPC ..... 347/101–105, 9, 16, 25, 30, 34, 37, 77, 347/78, 82
See application file for complete search history.

(56) References Cited

U.S. PATENT DOCUMENTS 3,972,051 A * 7/1976 Lundquist et al. ..... 347/74
4,297,712 A * 10/1981 Lammers et al. ..... 347/21
(Continued)

FOREIGN PATENT DOCUMENTS

CN 1184870 A 6/1998
GB 1 532 686 A 11/1978
(Continued)

OTHER PUBLICATIONS

International Search Report in corresponding PCT/JP2010/005409 from the Japanese Patent Office, mailed Oct. 12, 2010 (3 pages).
(Continued)

*Primary Examiner* — Henok Legesse
(74) *Attorney, Agent, or Firm* — Finnegan, Henderson, Farabow, Garrett & Dunner, LLP

(57) ABSTRACT

The effect of air resistance acting on ink drops discharged from nozzles of an ink-jet head is appropriately controlled, for example, by means of a method suitable for a breathable medium, such as a cloth and the like. In this way, for example, high-resolution printing, printing with a great gap distance, and the like is properly implemented.

An ink-jet printer 10, for printing on a breathable medium 50 through which air passes from a printing surface to a rear surface, includes an ink-jet head 12 for discharging ink drops toward the medium 50, and a rear side component 14, having a hollow portion that opens its space toward the rear surface of the medium 50; and then ink-jet head 12 includes nozzles for discharging ink drops to the medium 50, and an airflow blowing section for blowing airflow, at least a part of the airflow going through a travel path of the ink drops, and the airflow moving toward the medium 50 together with the ink drops; and the rear side component 14 receives the
(Continued)

airflow, passing through from the printing surface of the medium 50 to the rear surface of the same, with the hollow portion.

15 Claims, 7 Drawing Sheets

(51) Int. Cl.

| | |
|---|---|
| ***B41J 11/06*** | (2006.01) |
| ***D06B 1/14*** | (2006.01) |
| ***D06P 5/30*** | (2006.01) |

(56) References Cited

U.S. PATENT DOCUMENTS

| | | | | | |
|---|---|---|---|---|---|
| 4,591,869 | A * | 5/1986 | Katerberg | B41J 2/20 | 347/21 |
| 4,672,397 | A * | 6/1987 | Suga et al. | 347/21 | |
| 5,287,123 | A * | 2/1994 | Medin et al. | 347/17 | |
| 5,500,667 | A * | 3/1996 | Schwiebert et al. | 347/102 | |
| 5,935,331 | A * | 8/1999 | Naka | B05B 5/0255 | 118/319 |
| 5,966,145 | A * | 10/1999 | Miura et al. | 347/9 | |
| 6,030,076 | A * | 2/2000 | Yoshimura et al. | 347/106 | |
| 6,254,092 | B1 * | 7/2001 | Yraceburu et al. | 271/276 | |
| 6,305,772 | B1 * | 10/2001 | Berkoben et al. | 347/4 | |
| 6,340,225 | B1 * | 1/2002 | Szlucha | 347/102 | |
| 6,390,618 | B1 * | 5/2002 | Wotton et al. | 347/102 | |
| 6,554,389 | B1 * | 4/2003 | Hawkins et al. | 347/19 | |
| 6,682,238 | B2 * | 1/2004 | Yraceburu et al. | 400/635 | |
| 6,719,398 | B1 * | 4/2004 | McElfresh et al. | 347/21 | |
| 6,981,766 | B2 * | 1/2006 | Tsuji | 347/104 | |
| 6,984,028 | B2 * | 1/2006 | Steiner | 347/74 | |
| 7,537,332 | B2 * | 5/2009 | Nakazawa | 347/102 | |
| 7,604,332 | B2 * | 10/2009 | Nagashima | 347/84 | |
| 8,596,742 | B2 * | 12/2013 | Leoni et al. | 347/16 | |
| 8,622,538 | B2 * | 1/2014 | Miyakoshi et al. | 347/101 | |
| 2001/0046404 | A1 * | 11/2001 | Wotton et al. | 400/578 | |
| 2002/0027586 | A1 * | 3/2002 | Kikuchi et al. | 347/104 | |
| 2002/0033865 | A1 | 3/2002 | Ishinaga et al. | | |
| 2002/0075371 | A1 * | 6/2002 | Beehler et al. | 347/101 | |
| 2003/0016276 | A1 * | 1/2003 | Jeanmaire | 347/77 | |
| 2003/0043246 | A1 * | 3/2003 | Codos | 347/102 | |
| 2003/0142187 | A1 * | 7/2003 | Elgee et al. | 347/102 | |
| 2004/0169712 | A1 * | 9/2004 | Tsuji | 347/104 | |
| 2004/0174421 | A1 * | 9/2004 | Tsuji | 347/104 | |
| 2005/0190242 | A1 * | 9/2005 | Steiner | 347/82 | |
| 2006/0232624 | A1 * | 10/2006 | Inoue | 347/23 | |
| 2006/0238561 | A1 * | 10/2006 | Carcia et al. | 347/30 | |
| 2007/0229611 | A1 * | 10/2007 | Nagashima | 347/84 | |
| 2008/0278548 | A1 * | 11/2008 | Brost et al. | 347/77 | |
| 2009/0031579 | A1 * | 2/2009 | Piatt et al. | 34/82 | |
| 2009/0179939 | A1 * | 7/2009 | Ide | B41J 2/14032 | 347/21 |
| 2010/0103237 | A1 * | 4/2010 | Hara et al. | 347/102 | |
| 2010/0110156 | A1 * | 5/2010 | Hara et al. | 347/102 | |
| 2010/0157006 | A1 * | 6/2010 | Kanada et al. | 347/102 | |
| 2010/0225695 | A1 * | 9/2010 | Fujikura | B41J 11/002 | 347/16 |
| 2010/0245513 | A1 * | 9/2010 | Ihara | B41J 2/14274 | 347/102 |
| 2010/0271425 | A1 * | 10/2010 | Bober | 347/34 | |
| 2011/0012967 | A1 * | 1/2011 | Hsu et al. | 347/90 | |
| 2011/0109693 | A1 * | 5/2011 | Ohnishi | 347/34 | |
| 2011/0304868 | A1 * | 12/2011 | Ohnishi | 358/1.9 | |
| 2011/0310179 | A1 * | 12/2011 | Ohnishi | B41J 2/04 | 347/44 |
| 2012/0001991 | A1 * | 1/2012 | Onozawa | B41J 11/002 | 347/102 |
| 2012/0249703 | A1 * | 10/2012 | Nishimura | 347/102 | |

FOREIGN PATENT DOCUMENTS

| | | | | |
|---|---|---|---|---|
| JP | H08-238766 | A | 9/1981 | |
| JP | 56-154565 | A | 11/1981 | |
| JP | S56-154565 | A | 11/1981 | |
| JP | 62039249 | A * | 2/1987 | |
| JP | 6-278275 | A | 10/1994 | |
| JP | 8-238766 | A | 9/1996 | |
| JP | 10-67106 | A | 3/1998 | |
| JP | 10-168765 | A | 6/1998 | |
| JP | H10-168765 | A | 6/1998 | |
| JP | 2003-96658 | A | 3/2003 | |
| JP | 2003-096658 | A | 4/2003 | |
| JP | 2007-46209 | A | 2/2007 | |
| JP | 2009101609 | A * | 5/2009 | |
| JP | KR 20120046290 | A * | 5/2012 | B41J 2/105 |

OTHER PUBLICATIONS

Search Report, issued from the European Patent Office in corresponding Application No. EP 10813511.2, dated Mar. 31, 2015, 6 pages.

First Office Action, issued from the State Intellectual Property Office of the People's Republic of China in counterpart Application No. 2010800337029, dated Mar. 4, 2013, 9 pages including translation.

Notice of Preliminary Rejection, issued from the Korean Intellectual Property Office in counterpart Application No. 10-2012-7004897, dated May 31, 2013, 6 pages including translation.

Notification of Reason for Rejection, issued from the Japanese intelleotual Property Office in counterpart Apoltcrition No. 2011-529818. dated Jul. 18, 2013. 10 pages including translation.

Notification of Reason for Rejection, issued from the Japanese Intellectual Property Office in counterpart Application No. 2011-529818, dated Nov. 22, 2013, 3 pages inciuding translation.

Office Action dated May 19, 2016, from the European Patent Office in related European Patent Application No. 10813511.2 (3 pages).

* cited by examiner

INKJET PRINTER AND PRINTING METHOD

FIELD OF THE INVENTION

The present invention relates to an ink-jet printer and a printing method.

BACKGROUND

Conventionally, used widely are ink-jet printers that put a printing process into practice by discharging ink drops out of nozzles. Those ink-jet printers have a feature that the printing process is implemented without contacting a medium, and various ways of application for those ink-jet printers are now under consideration.

PRIOR ART DOCUMENTS

Patent Documents

[Patent Document 1] Japanese Unexamined Patent Application Publication No. 2000-294591

[Patent Document 2] Japanese Unexamined Patent Application Publication No. H08-238766

[Patent Document 3] Japanese Unexamined Patent Application Publication No. H10-168765

SUMMARY OF INVENTION

Problem to be Solved

As the use of ink-jet printers expands in application, sometimes it is needed, depending on the application, for example to extend a distance between an ink-jet head and a medium (hereinafter, called a "gap distance"). Furthermore, in response to increasing requirements on a printing accuracy of ink-jet printers in recent years, it is desired, for example, to make the size of ink drops still finer.

When the size of ink drops is made to be fine for resolution enhancement, unfortunately a rapid decrease in speed of the ink drops is observed due to the effect of air resistance. As a result, when an ink-jet printer with a conventional machine structure carries out printing with a great gap distance, there comes up a disadvantageous phenomenon that landing spots of the ink drops become inaccurate. Therefore, in the case where fine ink drops with their size of several pico-liters, for example, are used for high-resolution printing, a gap distance for stable printing is restricted to 2 through 4 mm or shorter.

As a result, conventionally it has been sometimes impossible to demonstrate an advantageous effect of contactless printing, which is a feature of ink-jet printers. For example, in the case of printing on a medium with fluffing, such as cloth and the like, even though a great gap distance is needed in order to avoid interference by the fluffing, implementation of such a printer that carries out printing with a sufficiently great gap distance has been hardly possible. Therefore, it has been desired in the past to adequately control the effect of air resistance acting on ink drops while they are flying. It is an object of the present invention to provide an ink-jet printer and a printing method that offer a solution to the problem described above.

Incidentally, Patent Document 1 relating to a bump forming apparatus that discharges molten solder from a nozzle, while inert gas being introduced, has been found according to research on prior arts relating to the present invention. Furthermore, another finding is Patent Document 2, which relates to an ink-jet recording apparatus that makes use of airflow and electrostatic force. Nevertheless, configurations described in these patent documents are those for offering solutions to problems that are quite different from what the present invention takes up. Moreover, those configurations are also different from that of the present invention.

Still another finding is Patent Document 3 relating to a printer for printing, while pushing down fluff on the surface of textile by air blowing from an ink-jet head side toward the textile on the opposite side. A configuration according to this case found is intended for implementation of printing while narrowing a gap distance by pushing down the fluff. Therefore, the configuration is also quite different from the subject and configuration the present invention aims at.

Means to Solve the Problem

Kinetic energy of a flying liquid drop is proportionate to a mass of the drop. In the meantime, the mass of the liquid drop is proportionate to a radius 'r' to the 3rd power ($r^3$). The radius of the liquid drop is a radius of the liquid drop, for example, under conditions where a form of the liquid drop is approximated to a globe.

On the other hand, air resistance acting on the flying liquid drop in the air includes a component that is proportionate to the radius 'r', and another component that is proportionate to the square of the radius 'r' (r2). Accordingly, the air resistance as a whole becomes proportionate to a value in a range from 'r' to 'r2.' Then, based on such a relation between the kinetic energy and the air resistance, in the case of the liquid drop flying in the air, the effect of air resistance becomes more significant if the size of the liquid drop is smaller.

Therefore, in order to appropriately downsize ink drops for example, it is necessary to sufficiently control the effect of air resistance. Also, in the case of making a gap distance greater for example, it is necessary to sufficiently control the effect of air resistance, since a time period of the air resistance acting on the ink drops lasts longer.

To solve the problem described above, the inventor of the present invention considered generating airflow around the flying ink drops to assist the ink drops in their flying motion. Then, in the course of intense studies, the inventor found that, in the case of generating such airflow, turbulence comes up in the airflow at the time when the airflow reaches a surface of a medium so that landing accuracy of the ink drops is sometimes badly affected. Focusing attention on this subject, the inventor further studied intensely, and eventually found structures of the present invention that enables further appropriate printing by using such airflow. To give a solution to the problem described above, the present invention includes the following structures.

(Structure 1) An ink-jet printer for printing on a breathable medium through which air passes from a printing surface to a rear surface, including: an ink-jet head for discharging ink drops toward the medium; and a rear side component, provided at a side of the rear surface of the medium, and having a hollow portion that opens its space toward the rear surface of the medium; wherein, the ink-jet head includes; nozzles for discharging ink drops to the medium; and an airflow blowing section for blowing airflow, at least a part of the airflow going through a travel path of the ink drops, and the airflow moving toward the medium together with the ink drops; and the rear side component receives the airflow, passing through from the printing surface of the medium to the rear surface of the same, with the hollow portion. The rear side component is placed at a position so as to come face to face with the ink-jet head across the medium.

"The airflow, wherein at least a part of the airflow going through a travel path of the ink drops" means that, for example, a part of the airflow with a certain wide-spreading extent substantially passes through the travel path of the ink drops. Then, "to substantially passes through the travel path of the ink drops" means that, for example, a sufficient amount of airflow for assisting the ink drops in their flying motion passes through the path of the ink drops from the nozzles to the medium. Meanwhile, "assisting the ink drops in their flying motion" means, for example, reducing the effect of air resistance acting on the ink drops while the ink drops are flying to the medium.

According to this structure, the airflow that has reached the medium, for example, farther goes forward to pass through the medium and eventually enter the hollow portion. Therefore, according to this structure for example, it is possible to appropriately prevent turbulence from coming up in the airflow that has reached the medium. Moreover, in this way for example, applying the method suitable for the breathable medium makes it possible to appropriately reduce the effect of air resistance acting on the ink drops while the ink drops are flying to the medium.

Furthermore, in this way for example, even in the case where the ink drops are downsized to be finer, the ink drops can still reach the medium appropriately. Therefore, for example, the ink drops can be downsized properly to be finer. The ink-jet head may discharge ink drops, for example, having their size (volume) of 1 pico-liter or less (e.g., 0.1 to 1 pico-liter) from the nozzles. In this way for example, high-resolution printing can be done in a more appropriate manner, in comparison with a case where no airflow is generated. Meanwhile, since the effect of air resistance is controlled, it is also possible to increase a flying distance of ink flying without changing into mist. Therefore, for example, the gap distance can also be made greater.

Moreover, by applying the structure in which airflow having reached the medium is unlikely to become turbulence, for example, high-speed airflow can appropriately be generated. Thus, for example, the effect of air resistance acting on ink drops can more appropriately be controlled. Furthermore, in the case of using any ink that is fixed onto the medium by means of drying, there also comes up an effect that the ink is easily dried, for example, owing to the structure in which the airflow passes through the medium.

Incidentally, the ink-jet printer carries out printing at resolution of 150 dpi (dots per inch) or higher. The ink-jet head includes a plurality of nozzles, laid out in a line, as a line of nozzles on a nozzle surface that faces the medium. The line of nozzles is a series of nozzles including, for example, 100 or more nozzles placed in a line, in a direction of the line of nozzles. Meanwhile, the airflow blowing section generates slit-like airflow, shaped along the line of nozzles in a longitudinal direction, from both sides being adjacent to the line of nozzles.

It is supposed that, when used is a ink-jet head equipped with a single nozzle or a small number of nozzles that are moreover laid out at long intervals, generating airflow from an area surrounding the nozzle(s) may properly assist ink in its flying motion. Nevertheless, for high-resolution printing, used usually is an ink-jet head including a line of nozzles in which nozzles exceeding several hundreds in number are lined up. Then, these nozzles are laid out at short intervals corresponding to a high resolution level, for example, exceeding a resolution level of approx. 150 dpi (dots per inch). In such a case, simply generating airflow surrounding the nozzles may possibly not assist the ink in its flying motion appropriately.

On the other hand, according to the structure described above, the airflow for assisting the ink drops in their flying motion can appropriately be generated in the structure using the line of nozzles suitable for high-resolution printing. Furthermore, for example, by generating the airflow for a line of nozzle as one unit collectively, the structure for generating the airflow can be implemented at low cost, in comparison with a case where used is a structure for generating airflow for each nozzle separately.

Furthermore, the airflow blowing section may generate airflow including a plurality of streams that are separate each other, for example, in accordance with a distance from the nozzles. For example, the airflow blowing section may blow, as the airflow, main airflow that moves toward the medium along the ink drops discharged from the nozzles, as well as sub airflow that moves toward the medium along the ink drops while sandwiching the main airflow in the sub airflow itself.

(Structure 2) The ink-jet printer further includes an air-intake pump for generating a negative pressure at the rear surface of the medium by sucking in air from the hollow portion of the rear side component.

According to this structure, for example, the airflow can pass through the medium in a more appropriate manner. Furthermore, in this way, it is possible to prevent turbulence in a more appropriate manner from coming up in the airflow that has reached the medium.

Moreover, according to this structure, since the rear surface side of the medium is negatively pressurized, for example, it is also possible to achieve an effect that ink can easily enter an internal portion of the medium. Therefore, in the case of manufacturing a product; such as a banner, a scarf, and the like; wherein printed designs of the product being viewed from a rear surface side of the product as well, by using textile, e.g., a cloth and so on as the medium, printing can be done more properly in such a way that ink goes through the product down to the rear surface side. Thus, it becomes possible to manufacture a product having a high commercial value, and obtain a printed product that meets a market need more adequately.

Incidentally, the air-intake pump may selectively generate a negative pressure for a position where the ink drops arrive, or a portion neighboring to the position, on a rear surface side of the medium. For example, when printing is carried out by using an ink-jet head scanning in a widthwise direction of the medium, conceived is a use of a rear side component equipped with a hollow portion that is split in the widthwise direction of the medium. In this case, for example, according to the position of the ink-jet head in the widthwise direction of the medium, the air-intake pump sucks in air at a position of the hollow portion, which faces the ink-jet head.

(Structure 3) The rear side component further includes a plate-like multi-hole plate having a plurality of holes through which the airflow passes; and the multi-hole plate is provided in the hollow portion in such a way as to face the rear surface of the medium. According to this structure, for example, a more evenly equalized negative pressure can appropriately be generated. It is preferable that the multi-hole plate is provided, for example, in such a way as to have a clearance from the rear surface of the medium.

(Structure 4) The medium is a medium having fluff, at least, on its printing surface; and the ink-jet head discharges the ink drops from a position that is free from interfering with the fluff even under the condition of fluffing of the fluff. "A medium having fluff on its printing surface" means, for example, a fibrous medium, such as a cloth and the like. For example, the medium may be textile.

According to this structure, for example, when being carried out by having a sufficiently great gap distance, printing can be done appropriately while controlling the effect of fluff. Thus, in this way, high-resolution printing can be done for a medium having fluff in an appropriate manner.

(Structure 5) The medium is a mesh-like medium in which micro-holes are formed in order for the ink to pass through the micro-holes from the printing surface to the rear surface. The medium may be a medium to be used as a large printing material, for example, such as an outdoor advertisement and the like. In this case, the medium has a width of, for example, 1 meter or wider (e.g., 1 to 6 meters). Moreover, the mesh-like medium may be, for example, a perforated film and so on through which air can pass through.

In the case of printing on such a large-sized medium and the like, it is not easy to keep the medium flat at the time of printing, and the printing surface is likely to have undulation due to slackness and so on, of the medium. Then, in the case of a small gap distance, there may also come up a case in which interference is caused between the ink-jet head and the medium to disable appropriate printing.

On the other hand, according to the structure described above, while used is the mesh-like medium that is a breathable medium, it is possible to control turbulence in the airflow on the surface of the medium, and to appropriately generate the airflow for assisting the ink drops in their flying motion. Thus, in this way, it becomes possible to set a sufficiently great gap distance to avoid interference between the ink-jet head and the medium, for example, even when undulation is caused on the printing surface of the medium. Therefore, according to this structure, high-resolution printing can appropriately be done, for example, for the mesh-like medium.

Incidentally, a gap distance of 10 mm or greater (e.g., 10 to 100 mm) is conceived. Furthermore, even a gap distance of 100 mm or greater may be applied.

(Structure 6) A printing method for printing by means of ink jet on a breathable medium through which air passes from a printing surface to a rear surface, including: discharging ink drops from nozzles to the medium; blowing airflow, at least a part of the airflow going through a travel path of the ink drops, and the airflow moving toward the medium together with the ink drops; and receiving the airflow, passing through from the printing surface of the medium to the rear surface of the same, with a hollow portion by using a rear side component, provided at a side of the rear surface of the medium, and having the hollow portion that opens its space toward the rear surface of the medium. In this way, for example, an effect similar to that of Structure 1 can be achieved.

Advantageous Effect of the Invention

According to the present invention, the effect of air resistance acting on ink drops discharged from nozzles of an ink-jet head can appropriately be controlled, for example, by means of a method suitable for a breathable medium. In this way, it is possible to properly implement, for example, high-resolution printing, printing with a great gap distance, and the like.

BRIEF DESCRIPTION OF THE DRAWINGS

FIG. 2A is a sectional drawing, on a plane perpendicular to a direction of a line of nozzles, of the ink-jet head 12 and the rear-side member 14. FIG. 2B is a sectional drawing of the ink-jet head 12 and the rear-side member 14, being viewed along the line A-A.

FIG. 4A is a view showing an example of a case where the ink drops are discharged with a head in a static condition. In the meantime, FIG. 4B is a view showing an example of a case where the ink drops are discharged with the ink-jet head 12 being in motion.

FIG. 5A illustrates a result of observing trajectories of the ink drops, as a view model, while a position of the ink-jet head 12 being always kept at an origin. In the meantime, FIG. 5B is a drawing that explains the effect of airflow acting on an ink drop just after the ink drop is discharged.

FIG. 6A is a sectional drawing, on a plane perpendicular to a direction of a line of nozzles, of the ink-jet head 12 and the rear-side member 14. FIG. 6B is a sectional drawing of the ink-jet head 12 and the rear-side member 14, being viewed along the line A-A.

DESCRIPTION OF THE PREFERRED EMBODIMENT

Figure 1:
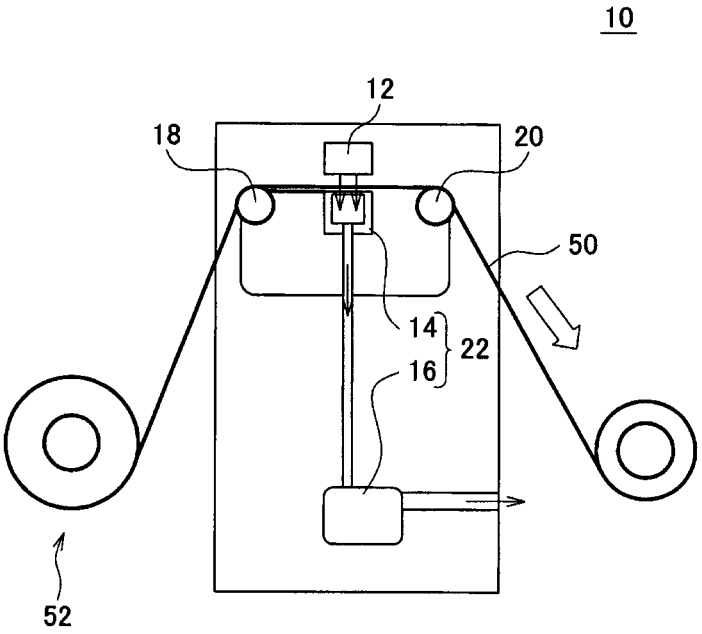
FIG. 1 is a view showing an example of a structure of an ink-jet printer 10 according to an embodiment of the present invention.

An embodiment according to the present invention is described below with reference to the accompanying drawings. FIG. 1 shows an example of a structure of an ink-jet printer 10 according to an embodiment of the present invention. The ink-jet printer 10 is a printing apparatus that implements printing on a medium 50 by an ink-jet method; and the ink-jet printer 10 includes an ink-jet head 12, a pulling roller 20, a back-tension roller 18, and a negative pressure generating mechanism 22. Furthermore, in the present example, the ink-jet printer 10 is a printing apparatus for printing by a multi-pass method, in which the ink-jet head 12 carries out scanning operation while traveling and discharging ink drops. The ink-jet printer 10 may be a printing apparatus for textiles.

In the present example, the ink-jet printer 10 implements printing on a breathable medium through which air passes in a direction from a printing surface to a rear surface. For example, a fibrous medium, such as a cloth and so on, can preferably be used as such a medium 50. Alternatively, the medium 50 may be a medium with fluff on its printing surface.

Furthermore, the medium 50 may be a porous medium in which a great number of micro-holes are formed for making air pass. For example, the medium 50 may be a mesh-like medium and the like, in which micro-holes are formed in order for ink to pass through the micro-holes from the printing surface to the rear surface. In this case, for example, the medium 50 may be a medium having no fluff on its printing surface. Then, in the present example, the medium 50 being rolled up is placed as a medium roll 52 in the ink-jet printer 10.

Incidentally, in the drawings discussed below, each element is illustrated with its size, its position, its required number, and so on being modified properly as a matter of convenience. Moreover, in addition to the structure illustrated, the ink-jet printer 10 may further be provided with any other structure required for transferring the medium 50 and printing on it.

The ink-jet head 12 is a printing head that discharges ink drops toward the medium 50, and the ink-jet head 12 includes a plurality of nozzles, laid out in a line, as a line of nozzles on a nozzle surface that faces the medium 50. Moreover, in the present example, the ink-jet head 12 further includes an airflow blowing section as a rectified-stream generating mechanism for generating rectified airflow, in order to blow airflow streaming toward the medium 50 along the ink drops. A structure of the ink-jet head 12 is explained later further in detail.

The pulling roller 20 and the back-tension roller 18 are included in a structure for unrolling and transferring the medium 50 out of the medium roll 52. Being placed at a downstream side after the ink-jet head 12 in a transfer direction of the medium 50, the pulling roller 20 pulls out the medium 50 to the downstream side in the transfer direction by turning operation of itself, in order to unroll the medium 50 from the medium roll 52. In the meantime, being placed at an upstream side before the ink-jet head 12 in the transfer direction of the medium 50, the back-tension roller 18 pulls back the medium 50 in a direction opposite to the direction in which the pulling roller 20 pulls the medium 50, in order to provide tension (back-tension) to the medium 50.

Thus, the pulling roller 20 and the back-tension roller 18 transfer the medium 50 while supporting the medium 50 in a period, for example, after ink drops land on the medium 50 and until they become dried, in such a way that nothing other than both the rollers contacts the medium 50. According to this construction, it is possible to properly prevent, for example, contamination at a rear surface of the medium 50.

The negative pressure generating mechanism 22 is a structure for generating negative pressure conditions at a rear surface side of the medium 50, and the mechanism includes a rear side component 14 and an air-intake pump 16. The rear side component 14 is a member having a hollow portion that opens its space toward the rear surface of the medium 50. As being placed at a position on the rear surface side of the medium 50 in such a way as to come face to face with the ink-jet head 12 across the medium 50, the rear side component 14 receives airflow with the hollow portion, while the airflow passing through from the printing surface of the medium 50 to the rear surface of the same. In the meantime, the air-intake pump 16 sucks in the air inside the hollow portion of the rear side component 14 in order to generate negative pressure conditions on the rear surface of the medium 50. In this way, the negative pressure generating mechanism 22 sucks in all or part of the airflow that the ink-jet head 12 generates. A pump having an air-intake function, for example a blower and the like, can suitably be used as the air-intake pump 16. The structure of the rear side component 14 is further explained later in detail.

Thus, in the above, an explanation is made on the basis that there exists only one ink-jet head 12, as a matter of convenience for explanation. Alternatively, the ink-jet printer 10 may includes a plurality of ink-jet heads 12. For example, the ink-jet printer 10 may have a plurality of ink-jet heads 12 for full-color printing, or ink-jet heads 12 for special colors, such as white, a clear color, and the like. These ink-jet heads may have the same or similar structure as the ink-jet heads 12, explained above as well as below, have.

As for ink to be used in the ink-jet printer 10, any ink can be used, for example, solvent ink, water-base pigment ink, water-base dye ink, UV ink, and the like; as far as the ink can be discharged by the ink-jet head 12. In the case of using any ink selected out of those described above, which is fixed onto the medium by means of drying, there also comes up an effect that the ink is easily dried, for example, owing to the structure in which the airflow passes through the medium 50.

Figure 2:
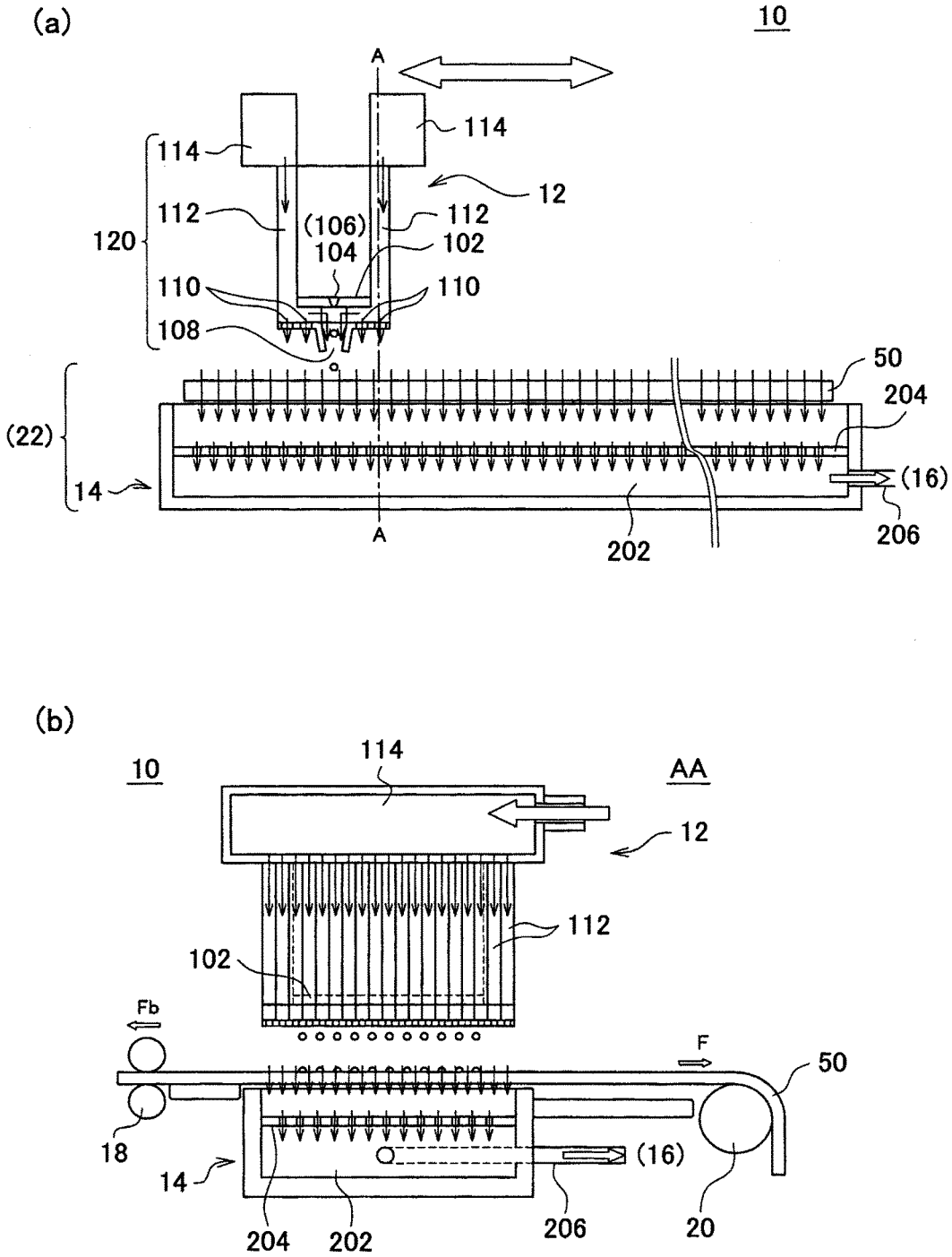
FIG. 2 includes sectional views showing a first example of a detailed structure of an ink-jet head 12 and a rear-side member 14.
Figure 3:
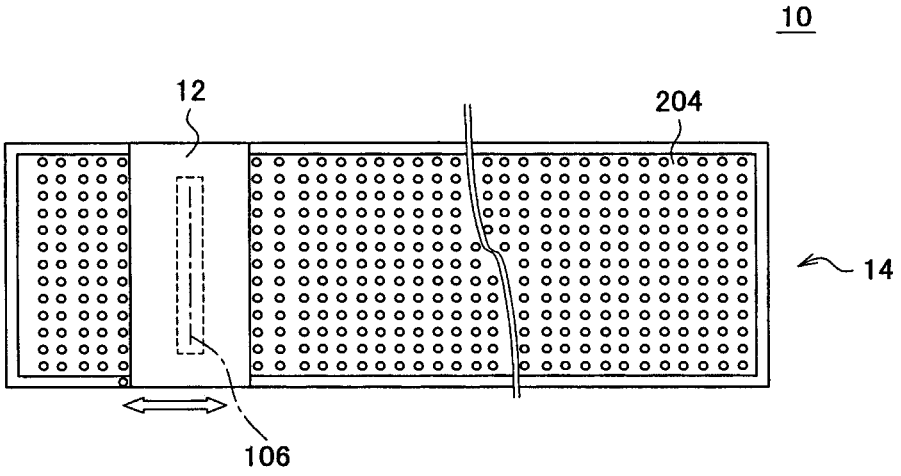
FIG. 3 is a top view of the ink-jet head 12 and the rear-side member 14.

FIG. 2 and FIG. 3 show a first example of a detailed structure of the ink-jet head 12 and the rear-side member 14. FIG. 2 shows sectional views of the ink-jet head 12 and the rear-side member 14. FIG. 2A is a sectional drawing, on a plane perpendicular to a direction of a line of nozzles, of the ink-jet head 12 and the rear-side member 14. FIG. 2B is a sectional drawing of the ink-jet head 12 and the rear-side member 14, being viewed along the line A-A; wherein this drawing shows a sectional view of the ink-jet head 12 and the rear-side member 14 on a plane indicated with the chain line A-A in FIG. 2A. FIG. 3 is a top view of the ink-jet head 12 and the rear-side member 14.

First of all, a structure of the ink-jet head 12 is explained. In the present example, the ink-jet head 12 includes a nozzle plate 102 and an airflow blowing section 120. The nozzle plate 102 is a plate member in which a line of nozzles 106 including a plurality of nozzles 104 laid out is shaped. In the present example, the line of nozzles 106 includes, for example, 100 or more nozzles 104 placed in a line, in a direction of the line of nozzles. In the present example, the ink-jet printer 10 is a printing apparatus for printing at resolution of 150 dpi (dots per inch) or higher, and the line of nozzles 106 includes the plurality of nozzles 104 laid out at intervals corresponding to the resolution.

The airflow blowing section 120 is a rectified-stream generating mechanism for generating rectified airflow, and it blows airflow streaming toward the medium 50 to assist ink drops in their flying motion. In the present example, the airflow blowing section 120 includes a main airflow blowing port 108, a sub airflow blowing port 110, a plurality of air guiding paths 112, and an air buffer 114.

The main airflow blowing port 108 and the sub airflow blowing port 110 are airflow blowing ports for assisting the ink drops in their flying motion. The main airflow blowing port 108 is a blowing port formed in the vicinity of the line of nozzles 106, and it blows main airflow that moves toward the medium 50 along the ink drops discharged from the nozzles 104. This main airflow is an example of airflow, wherein at least a part of the airflow goes through a travel path of the ink drops; and for example, it moves toward the medium 50 together with the ink drops. In the present example, the main airflow blowing port 108 generates slit-like airflow, shaped along the line of nozzles 106 in a longitudinal direction of the port, as the main airflow from both sides adjacent to the line of nozzles 106. Thus, the main airflow blowing port 108 blows the airflow for directly assisting the ink drops in their flying motion.

It is preferable to have a speed (flow velocity) of the main airflow in the same range as a discharging speed of the ink drops. Nevertheless, preferably the speed of the main airflow should arbitrarily be optimized in accordance with a material of the medium 50 to be used, a gap distance to be maintained in the expectation, a printing speed, and the like; and thus the speed is not restricted to any certain specific value.

The sub airflow blowing port 110 is a blowing port formed at a position sandwiching the main airflow blowing port 108 on the nozzle surface and being adjacent to the line of nozzles 106, and it blows sub airflow that moves toward the medium 50 along the ink drops while sandwiching the main airflow in the sub airflow itself. The sub airflow moves toward the medium 50 along the ink drops at a position, for example, wherein a distance to the position from the ink drops is greater than a distance to the main airflow from the same ink drops, in order to control a stream of the main airflow by the sub airflow streaming along the main airflow. The sub airflow blowing port 110 guides the main airflow still farther away while keeping the main airflow as laminar flow, for example, by means of blowing the sub airflow along the main airflow. In this way, the sub airflow blowing port 110 blows the airflow for indirectly assisting the ink drops in their flying motion by way of the main airflow.

Moreover, by streaming along the main airflow, the sub airflow controls the main airflow, for example, so as not to spread and not to decrease in speed. By blowing the sub airflow, the sub airflow blowing port 110, for example, supports the main airflow and keeps the same as rectified laminar flow. Therefore, according to this example, stable main airflow for example can be generated suitably. Thus, it is possible to properly assist the ink in its flying motion. Moreover, for example, by applying a structure that easily generates stable main airflow, it also becomes possible to further increase the speed of the main airflow. Therefore, in accordance with such a structure, the effect of air resistance acting on the ink drops can be controlled further appropriately.

Moreover, generating the sub airflow works effectively in particular, for example, for the ink-jet head 12 moving at high speed, or for launching the ink drops farther away. Therefore, in the case of the ink-jet head 12 moving at low speed, or a short gap distance, only the main airflow may be generated without generating any sub airflow.

The plurality of air guiding paths 112 are guiding routes for supplying air to the main airflow blowing port 108 as well as the sub airflow blowing port 110. In the present example, both sides of the line of nozzles in the ink-jet head 12 are individually provided with the plurality of air guiding paths 112 segmented with partition walls.

On the way from the air buffer 114 to the main airflow blowing port 108 as well as the sub airflow blowing port 110, the plurality of air guiding paths 112 are provided side by side in such a way as to sandwich the line of nozzles 106, for sending the air supplied from the air buffer 114 to the main airflow blowing port 108 and the sub airflow blowing port 110. Then, by blowing the air through the segmented paths, each of the air guiding paths 112 rectifies the air, which moves to the main airflow blowing port 108, toward almost the same direction as the discharging direction of the ink drops. As a result, the plurality of air guiding paths 112 makes up the slit-like main airflow, which moves to the medium 50 in such a way as to wrap up the ink drops and also covers the line of nozzles 106, and sends the main airflow to the main airflow blowing port 108.

Incidentally, each of the plurality of air guiding paths 112 is so segmented as to have a uniformed shape, and therefore provided with equalized air resistance characteristics. The air introduced through the air guiding paths 112 located at both the sides of the line of nozzles 106 come together, while almost centering around the line of nozzles 106, as shown in FIG. 2A. Then, the air is blown out, as the main airflow, through the main airflow blowing port 108 in a downward direction in the drawing, while the direction being the same as the flying direction of the ink drops discharged from the nozzles 104. In the meantime, part of the air introduced is blown out, as the sub airflow, through the sub airflow blowing port 110.

It is preferable that a width of the arrangement of the plurality of air guiding paths 112 is greater than a width of the line of nozzles 106 in the direction of the line of nozzles. According to such a structure, it is possible to appropriately generate the rectified main airflow, for example, with a greater width than the length of the line of nozzles 106. Furthermore, according to the structure, it is possible to properly prevent turbulence from coming up in the rectified flow at both ends of the line of nozzles 106.

The air buffer 114 has greater pneumatic conductance than each of the plurality of air guiding paths 112, and it is provided at an upstream side before the plurality of air guiding paths 112. The air buffer 114 takes in pressurized air generated by a blower through an inlet port, and supplies the air to the plurality of air guiding paths 112; wherein the blower, for example, being installed outside the ink-jet head 12. In this way, the air buffer 114 stabilizes the pressure of the air to be supplied to the air guiding paths 112.

According to this structure, in the present example, pressurized air is supplied to the plurality of air guiding paths 112, each of which having equalized air resistance characteristics, from the air buffer 114 having sufficiently great pneumatic conductance. Then, each of the plurality of air guiding paths 112 guides the air, introduced through the air buffer 114, individually to the main airflow blowing port 108 and sub airflow blowing port 110.

According to the present example, for example, the rectified main airflow can be generated suitably. Then, it is possible to appropriately assist the ink in its flying motion. The structure of the airflow blowing section 120 can arbitrarily be modified, for example, in accordance with the structure of the ink-jet head 12 to be used. For the structure of the airflow blowing section 120, supposed is, for example, a use of various structures in which airflow is generated in a direction almost the same as the flying direction of the ink drops. For example, the air guiding paths 112 having a segmented construction as described above are just an example of a structure for easily obtaining rectified flow. As the plurality of air guiding paths 112, used may be any other type of paths segmented according to a structure being different from the illustrated one.

With respect to the structure of the airflow blowing section 120, explained above is a construction in which the airflow blowing section is unified together with a main body of the ink-jet head 12. Alternatively, it is further preferable to make up a construction in which the structure of the airflow blowing section is detachable from the main body of the ink-jet head 12. Then, such a structure makes it easy, for example, to clear contamination with ink, and so on.

To make the explanation easy in the above, illustrated and explained above is a case where the line of nozzles 106 includes the nozzles 104 laid out only in one line. Alternatively, the line of nozzles 106 may include the nozzles 104 in a plurality of lines; namely two lines, three lines or even more; for the purpose of, for example, speeding up, high-resolution improvement in printing operation.

With respect to the structure of the ink-jet head 12, explained above is a structure in which the air guiding paths 112, as a rectifying mechanism, and the like are provided for a single-color configuration. A similar structure can be applied for an ink-jet head in which heads for multiple colors, such as 4 colors, 6 colors, 8 colors, and so on, are collectively constructed.

A structure of the rear side component 14 is explained next. In the present example, the rear side component 14 includes a hollow portion 202, an exhaust port 206, and a multi-hole plate 204. The hollow portion 202 faces a rear surface of the medium 50, and it receives airflow coming through the medium 50. The exhaust port 206 is connected to the air-intake pump 16 so that, by means of sucking operation of the air-intake pump 16, the air inside the hollow portion 202 is exhausted.

The multi-hole plate 204 is a plate component having a plurality of holes through which airflow passes, and the multi-hole plate 204 is provided in the hollow portion 202 in such a way as to face the rear surface of the medium 50 with a clearance from the rear surface. Owing to the installation of the multi-hole plate 204, a negative pressure generated at the rear surface of the medium 50 can appropriately be controlled, and furthermore the generated negative pressure can appropriately be equalized. Incidentally, in the present example, the holes of the multi-hole plate 204 are round holes. A form of the holes can arbitrarily be modified, depending on the level of negative pressure to be generated, the suction power of the air-intake pump 16, or a purpose of the holes, such as an improvement in equality of the negative pressure, etc.

According to the present example, the airflow generated by the ink-jet head 12, for example, can appropriately pass through the medium 50. Thus, it is possible to appropriately prevent turbulence from coming up in the airflow that has reached the medium 50. Furthermore, by means of adopting a structure in which airflow is unlikely to change into turbulence, for example, high-speed airflow can appropriately be generated as required. Therefore, according to the present example, it is possible to appropriately generate the airflow for assisting the ink drops in their flying motion. Then, in this way, the effect of air resistance acting on the flying ink drops can appropriately be controlled.

Incidentally, for the purpose of reducing a load on the negative pressure generating means, for example, while a printing area being split in its widthwise direction, a negative pressure may be generated only in the section for actual printing or a portion neighboring to the section, by means of controlling a pneumatic valve and a plurality of blowers. In this case, the rear side component 14 includes, for example, a hollow portion 202 that is split in a widthwise direction of the medium 50. Moreover, for example, according to the position of the ink-jet head 12, the air-intake pump 16 sucks in air at a position of the hollow portion 202, which faces the ink-jet head 12. Thus, the air-intake pump 16 selectively generates a negative pressure for a position where the ink drops arrive, or a portion neighboring to the position, on a rear surface side of the medium 50.

When a negative pressure is generated on the rear surface side of the medium 50 as described in the present example, the medium 50 is subject to a force toward a side of the rear side component 14. Therefore, it is supposed that the medium 50 is likely to get drawn into the hollow portion 202 of the rear side component 14 owing to the force. However, in the present example, the ink-jet printer 10 provides the medium 50 with a back-tension 'Fb' by using the back-tension roller 18 and the pulling roller 20, and then transfers the medium 50 while keeping it floating in the range up to the pulling roller 20 that works as a feeding roller. Therefore, this structure properly protects the medium 50 from being drawn into the rear side component 14 due to the negative pressure.

Figure 4:
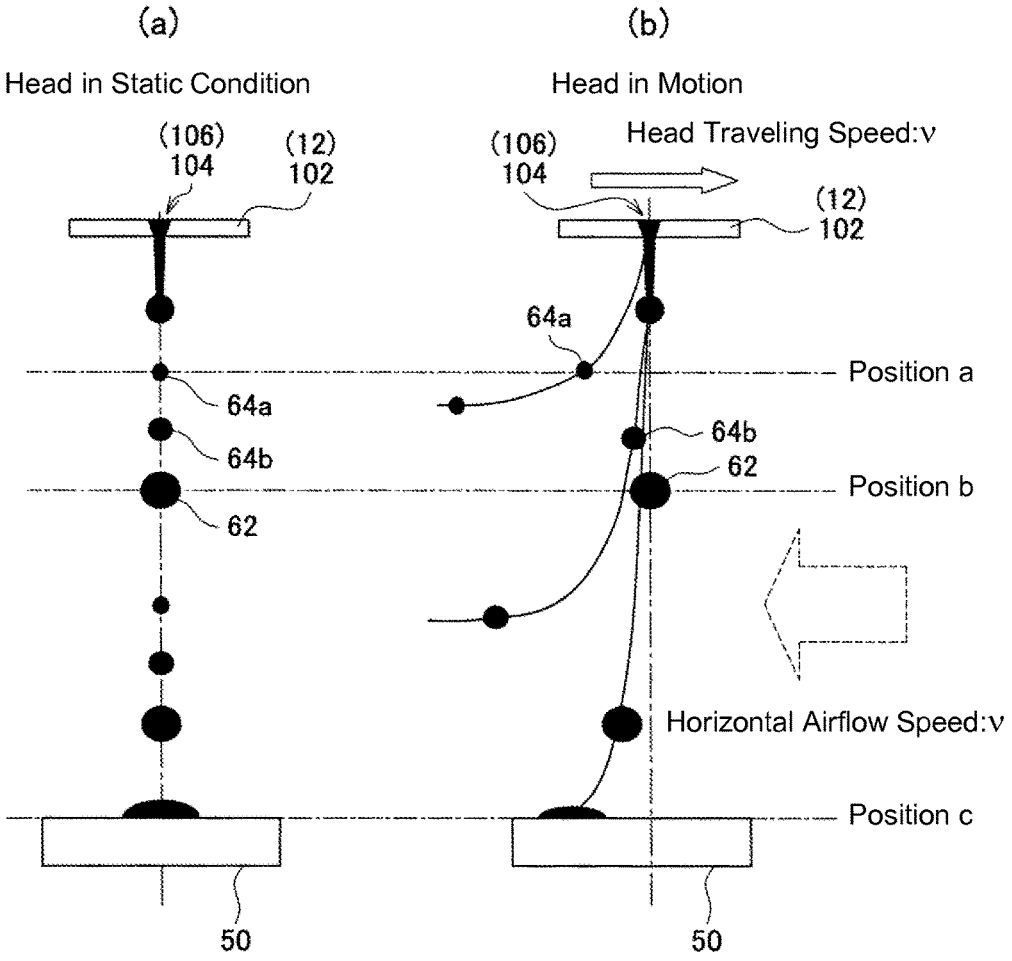
FIG. 4 includes views that explain flying motion of ink drops under conditions where no airflow is generated.
Figure 5:
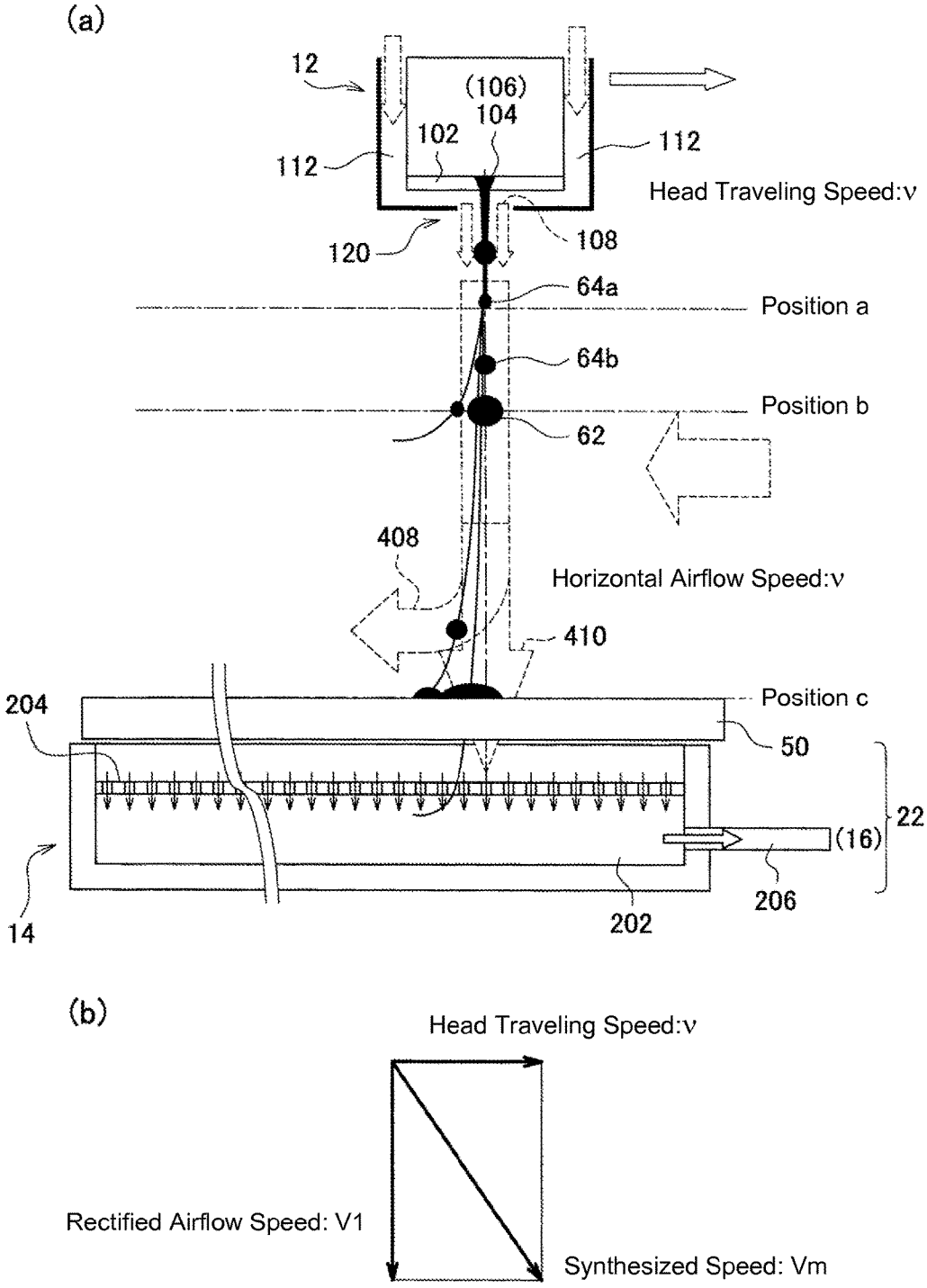
FIG. 5 includes views that explain flying motion of ink drops according to the structure of the present example.

FIG. 4 and FIG. 5 show drawings for explaining the effect of airflow generation in further detail. FIG. 4 includes views that explain flying motion of ink drops under conditions where no airflow is generated. FIG. 4A is a view showing an example of a case where the ink drops are discharged while the ink-jet head 12 being in a static condition; and the view shows a case of printing in a calm state, as a view model, while the medium 50 being positioned in a direction under the ink-jet head 12 (i.e., in the direction of the drawing force).

Supposed in the example illustrated is a case where a major drop 62 is discharged from the ink-jet head 12, being accompanied by a small satellite drop 64*a* and a large satellite drop 64*b*. The major drop 62 is an ink drop in a size, for example, according to a printing resolution. In a state of the ink-jet head 12 being in a static condition, the satellite drops 64*a* and 64*b* move in such a way as to follow the major drop 62, and therefore the effect of air resistance is reduced. Accordingly, the satellite drops 64*a* and 64*b* catch up with the major drop 62 to unite together with it; or even if they do not unite together, the satellite drops 64*a* and 64*b* land at the same position as the major drop 62 does, as shown in the drawing, as far as their speed does not become almost zero, since no biasing force acts on the satellite drops.

Meanwhile, generation of satellite drops sometimes becomes a problem, in the case where ink drops are discharged while the ink-jet head 12 is traveling for scanning operation, or printing is done in an ordinary atmosphere that is not a calm state. FIG. 4B is a view showing an example of a case where the ink drops are discharged with the ink-jet head 12 being in motion; and the view illustrates a result of observing trajectories of the ink drops, as a view model, while a position of the ink-jet head 12 being always kept at an origin in synchronization with the motion of the ink-jet head 12 traveling at a speed of 'V.'

According to the observation by means of this method, the major drop 62 as well as the satellite drops 64*a* and 64*b* follow the same trajectory to drop straight downward to the medium 50, on the assumption that the ink drops are free from any speed reduction due to air resistance, and furthermore the effect of airflow in a horizontal direction does not depend on the size of the ink drops.

Meanwhile, the flying condition of the ink drops in fact is different from the above assumption. Then, smaller the size of an ink drop is, more different the effect of air resistance acting on the drop is. According to the observation by means of the method described above, the ink drop is affected by airflow streaming at a speed of 'V' in a horizontal direction that is opposite to the traveling direction of the ink-jet head 12, in response to the traveling motion of the ink-jet head 12 at the speed of 'V.'

As a result, the small satellite drop 64*a* largely affected by the air resistance is drifted by the horizontal airflow so as to change into mist, for example, at a position 'a' closer to a nozzle 104, as it is understood according to the drawing. In the meantime, at a position 'b' farther from the nozzle 104, the large satellite drop 64*b* also changes into mist, so that only the major drop 62 reaches the medium 50. Moreover, for example if the medium 50 is so placed as to be farther away, the major drop 62 also changes into mist at a position farther away from a position 'c.'

According to the explanation above, it is understood that; in the case of a small-sized ink drop or a great gap distance, for example, sometimes the effect of air resistance becomes significant so that changing into mist and the like of the drop may happen before the drop lands on the medium 50 and eventually printing cannot be done appropriately. Furthermore, if once the drop changes into mist, for example, an internal part of the ink-jet printer 10 is contaminated so as to lead to a need of maintenance work and so on.

On the other hand, in the present example, the airflow for assisting ink drops in their flying motion is generated in order to control the effect of air resistance. Then, for example, even in the case of a small-sized ink drop or a great gap distance, printing can be done appropriately.

FIG. 5 includes views that explain flying motion of ink drops according to the structure of the present example. FIG. 5A illustrates a result of observing trajectories of the ink drops, as a view model, while a position of the ink-jet head 12 being always kept at an origin. In the meantime, FIG. 5B is a drawing that explains the effect of airflow acting on an ink drop just after the ink drop is discharged.

In the present example, the main airflow blown out of the main airflow blowing port 108 assists ink drops in their flying motion so that a velocity component of the ink drops in the direction toward the medium 50 increases. Accordingly, for example, even the small satellite drop 64*a* having a size for barely reaching the position 'a' in the case of no airflow generated becomes able to reach the farther position 'b.' In this case, for example, if the gap distance is made so smaller as to place the medium 50 at a position higher than the position 'b', it is still possible to appropriately keep the small satellite drop 64*a* from changing into mist.

Furthermore, in the case of the large satellite drop 64*b* having a size for barely reaching the position 'b' when no airflow is generated, the large satellite drop reaches the medium 50 in the same way as the major drop 62 does. Moreover, since the flying speed increases owing to the assist by the airflow, the landing position of the major drop 62 becomes still more accurate to get close to a center point.

Incidentally, in a real space having no synchronization with the traveling motion of the ink-jet head 12, an ink drop in an early phase of discharge, i.e., just after the discharge, is subject to a force in an oblique direction, obtained by synthesizing an inertia force according to the traveling motion of the ink-jet head 12 and the effect of airflow, for example, as shown in FIG. 5B. More specifically to describe, for example just after the discharge, the ink drop is subject to the inertia force according to the traveling speed 'V' of the ink-jet head 12 in the traveling direction of the ink-jet head 12. Also, the ink drop is subject to a force according to a speed of rectified airflow 'V1', which is an initial speed of the main airflow, in a direction toward the medium 50 by the rectified main airflow. Consequently, while a vector being obtained as a result of synthesizing the traveling speed 'V' of the ink-jet head 12 and the speed of rectified airflow 'V1', the ink drop is subject to a force in the oblique direction that the vector is directed to, according to a synthesized speed 'Vm' of the size of the vector; and then the ink drop moves toward the medium 50 in the oblique direction.

As described above, according to the present example, ink drops can reach a farther medium with still higher accuracy, while a phenomenon of changing into mist being controlled. Furthermore, in this way, printing can be done still appropriately even in the case of high-resolution printing with small-sized ink drops (major drops), and also in the case of a great gap distance.

The size (volume) of the ink drops (major drops) may be, for example, 1 pico-liter or less (e.g., 0.1 to 1 pico-liter). For example, in the case where the size (volume) of the ink drops (major drops) is about 3 pico-liters (e.g., 2.5 to 3.5 pico-liter), for example, a gap distance of 10 mm or greater (e.g., 10 to 100 mm) is conceived. Furthermore, even a gap distance of 100 mm or greater may be applied.

In the present example, providing the negative pressure generating mechanism 22 makes it possible to assist ink drops more appropriately with airflow. For example, if the airflow moving toward the medium 50 is simply generated, the airflow changes its moving direction along the surface of the medium 50, for example, as shown with an arrow 408 in the drawing, at the time when the airflow reaches a surface of the medium 50 (printing surface), in such a way as to potentially cause the turbulence, for example, together with other airflow that further flows afterwards. Then, if once such turbulence is caused, the flying motion of the ink drops is disturbed so that it possibly becomes difficult for the ink drops to land onto the medium 50 with great accuracy. Moreover, as a result, high quality printing with high resolution may potentially become difficult.

On the other hand, in the present example; the medium 50, which is a breathable material such as cloth and the like, is used, and furthermore a negative pressure is generated at the rear surface side of the medium 50 by using the negative pressure generating mechanism 22. Therefore, at least part of, or most of the airflow that have reached the surface of the medium 50 passes straight through the medium, leaving the ink drops on the surface of the medium 50, as an arrow 410 shows in the drawing. Then, the airflow that has passed through the medium 50 is sucked into the negative pressure generating mechanism 22 positioned at the rear surface side.

Therefore, according to the present example, by using the airflow blowing section 120 (Refer to FIG. 2) as a rectified-stream generating mechanism and the negative pressure generating mechanism 22 in combination for example, it is possible to appropriately generate the airflow for assisting the ink drops in their flying motion while properly preventing the airflow at the printing surface side of the medium 50 from becoming turbulence. In this way, it becomes possible to print a high-definition image with a high resolution, for example, even in the case of small-sized ink drops, and also in the case of a great gap distance. Furthermore, by controlling the mist generation, it also becomes possible to stabilize the printing operation and prevent contamination of the machine.

Moreover, according to the present example, high-resolution printing with a great gap distance can be done, and therefore various materials can be used as the medium 50. For example, as described above, a medium having fluff on its printing surface, such as a cloth material, can be used as the medium 50. In this case, the ink-jet head 12 discharges ink drops, for example, from a position that is free from interfering with the fluff even under the condition of fluffing. According to such a structure, printing can be done appropriately while controlling the effect of fluff.

Besides media having fluff on their printing surface, for example, a mesh-like medium and the like may conceivably be used as the medium 50. In such a case, the medium 50 may be, for example, a large-sized medium to be used as a large printing material, such as an outdoor advertisement and the like. In this case, for example, printing with a great gap distance enables high-resolution printing in an appropriate manner even when a printing surface has undulation due to slackness and so on, of the medium. Furthermore, in this way, highly accurate printing can be done easily and properly even if the medium 50 is a large-sized material that is likely to have slackness and so on.

Moreover, in the present example, since the rear surface side of the medium 50 is negatively pressurized, for example, it is also possible to achieve an effect that ink can easily enter an internal portion of the medium 50. Therefore, in the case of manufacturing a product; such as a banner, a scarf, and the like; wherein printed designs of the product being viewed from a rear surface side of the product as well, printing can be done more properly in such a way that ink goes through the product down to the rear surface side. Thus, it becomes possible to manufacture a product having a high commercial value, and obtain a printed product that meets a market need more adequately.

Figure 6:
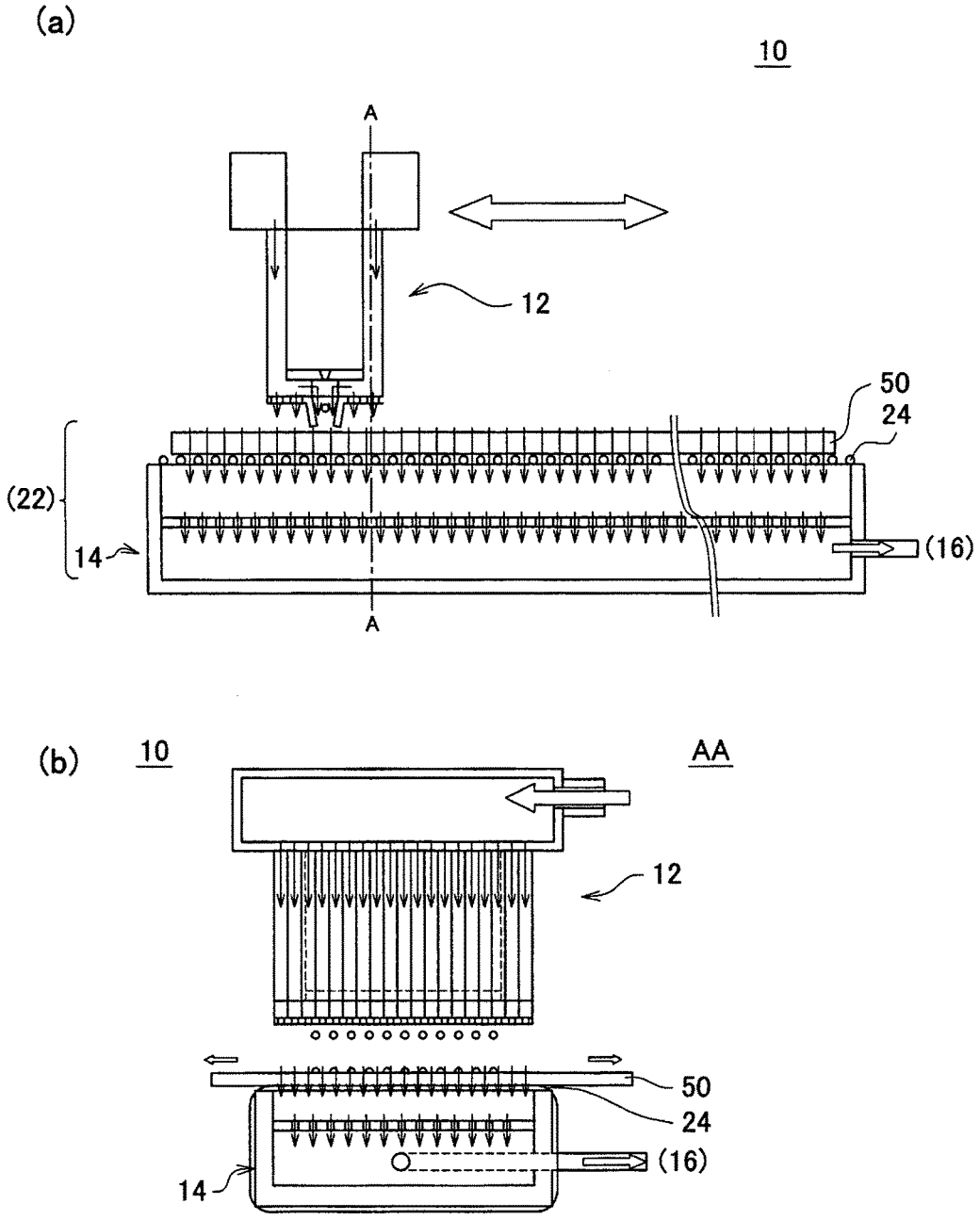
FIG. 6 includes sectional views showing a second example of a detailed structure of the ink-jet head 12 and the rear-side member 14.
Figure 7:
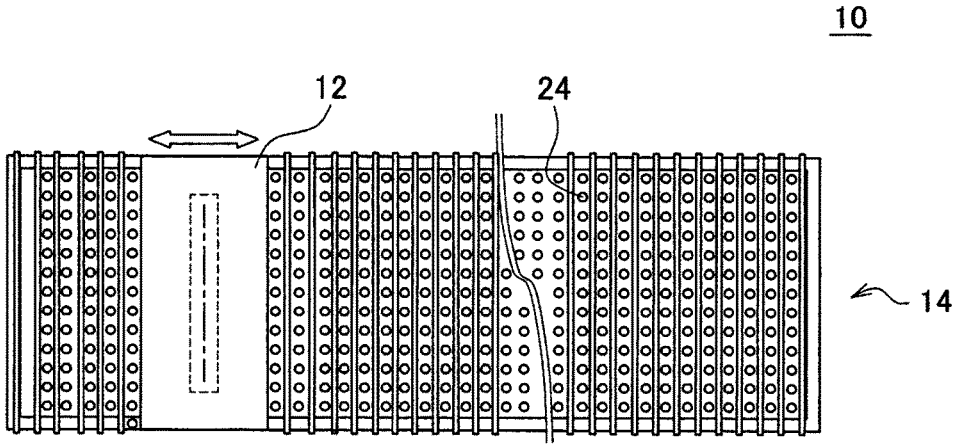
FIG. 7 includes top views of the ink-jet head 12 and the rear-side member 14.

FIG. 6 and FIG. 7 show a second example of a detailed structure of the ink-jet head 12 and the rear-side member 14. FIG. 6 shows sectional views of the ink-jet head 12 and the rear-side member 14. FIG. 6A is a sectional drawing, on a plane perpendicular to a direction of a line of nozzles, of the ink-jet head 12 and the rear-side member 14. FIG. 6B is a sectional drawing of the ink-jet head 12 and the rear-side member 14, being viewed along the line A-A; wherein this drawing shows a sectional view of the ink-jet head 12 and the rear-side member 14 on a plane indicated with a chain line in FIG. 6A. FIG. 7 is a top view of the ink-jet head 12 and the rear-side member 14.

The ink-jet head 12 in the present example is the same as, or similar to, the ink-jet head 12 illustrated in FIG. 2 and FIG. 3. With respect to other structural parts, except those described below, any part having the same reference numeral as its corresponding one in FIG. 2 and FIG. 3 is the same as, or similar to, the corresponding structural part in FIG. 2 and FIG. 3.

The rear side component 14 in the present example further includes an anti-drop safety net 24. The rear side component 14 has a structure for preventing the medium 50 from being drawn into the rear side component 14 due to a negative pressure, and it is made of stainless steel, polyethylene, or various plastic materials, etc.

In the present example, the anti-drop safety net 24 is provided right below the medium 50, and it always makes contact with the medium 50 by using a minimum contacting surface. The anti-drop safety net 24 may be provided while having a space between the rear surface of the medium 50 and the anti-drop safety net itself. In this case, the anti-drop safety net 24 makes contact with the medium 50 only when the medium 50 is nearly drawn in. Furthermore, as the anti-drop safety net 24, instead of the net including linear materials shown in the drawing, alternatively used may be a grating-like net in which linear materials in both vertical and horizontal directions intersect with each other. Moreover, in another modification, as a countermeasure for protecting the medium 50 from dropping, the rear side component 14 may include, for example, a bar-like anti-drop safety member instead of the anti-drop safety net 24.

In accordance with the present example, since the medium 50 is kept away from dropping for more sure, for example, a higher-level negative pressure can be given at the rear surface side of the medium 50. Then, accordingly it is possible to prevent the airflow from becoming turbulence in a more appropriate way.

The present invention is explained above with reference to an embodiment. Incidentally, the technological scope of the present invention is not limited to the scope described in the above embodiment. It is clear for those in art that various modifications and improvements can be made on the embodiment described above. According to the descriptions on the claimed scope, it is clear that any embodiment additionally having such modifications and improvements are also included in the technological scope of the present invention.

INDUSTRIAL APPLICABILITY

The present invention can suitably be used, for example, in an ink-jet printer.

REFERENCE NUMERALS

10. Ink-jet printer
12. Ink-jet head
14. Rear side component
16. Air-intake pump
18. Back-tension roller
20. Pulling roller
22. Negative pressure generating mechanism
24. Anti-drop safety net
50. Medium
52. Medium roll
62. Major drop
64*a* & 64*b*. Satellite drop
102. Nozzle plate
104. Nozzles
106. Line of nozzles
108. Main airflow blowing port
110. Sub airflow blowing port
112. Air guiding paths
114. Air buffer
120. Airflow blowing section
202. Hollow portion
204. Multi-hole plate
206. Exhaust port
408. Arrow
410. Arrow

What is claimed is:

1. An ink-jet printer for printing on a breathable medium having a printing surface and a back surface, comprising:

an ink-jet head for discharging ink drops to the medium; and a back side component provided at a side of the back surface of the medium, wherein the back side component has a hollow portion with an opening that opens towards the back surface of the medium;

wherein the ink-jet head includes:

nozzles for discharging the ink drops to the medium along respective travel paths; and an airflow blowing section for providing airflow to the medium with the ink drops, wherein at least a part of the airflow passes through at least one of the travel paths of the ink drops;

wherein the hollow portion of the back side component is configured to receive the airflow passing through from the printing surface of the medium to the back surface of the medium;

wherein the airflow blowing section includes a main airflow blowing port for blowing a main airflow and at least one sub airflow blowing port for blowing a sub airflow, the sub airflow blowing port being adjacent to the main airflow blowing port, the sub airflow being configured to stream along the main airflow and keep the main airflow as a laminar flow; and wherein each travel path of the ink drops passes through the main airflow blowing port.

2. The ink-jet printer according to claim 1, wherein the ink-jet printer includes an air-intake pump for generating a negative pressure at the back surface of the medium by sucking in air from the hollow portion of the back side component.

3. The ink-jet printer according to claim 2, wherein the back side component includes a multi-hole plate having a plurality of holes through which the airflow passes; and wherein the multi-hole plate is provided in the hollow portion and faces the back surface of the medium.

4. The ink-jet printer according to claim 1, wherein the medium includes fluff on at least its printing surface; and wherein the ink-jet head is configured to discharge the ink drops from a position that is free from interfering with the fluff under a condition of fluffing of the fluff.

5. The ink-jet printer according to claim 1, wherein the medium is mesh-like and includes micro-holes for passing the ink through them from the printing surface to the rear surface.

6. The inkjet printer according to claim 1, wherein the airflow blowing section includes at least one different sub airflow blowing port directly adjacent to the at least one sub airflow blowing port.

7. The ink-jet printer according to claim 1, wherein the main airflow blowing port and the at least one sub airflow blowing port have different shaped openings.

8. The ink-jet printer according to claim 1, wherein the airflow blowing section further includes at least one different sub airflow blowing port directly adjacent to the main airflow blowing port on an opposite side thereof with respect to the at least one sub airflow blowing port; and wherein at least part of the airflow passes through the at least one sub airflow blowing port and the at least one different sub airflow blowing port.

9. The ink-jet printer according to claim 1, wherein the main air flow blowing port is configured to provide airflow on two opposite sides of each travel path of the ink drops.

10. The ink-jet printer according to claim 1, wherein the main airflow is a slit-like airflow.

11. An ink jet printing method for printing on a breathable medium having a printing surface and a back surface, comprising:

discharging ink drops from nozzles to the medium along respective travel paths;

providing airflow to the medium with the ink drops;

passing at least a part of the airflow through at least one of the travel paths of the ink drops; and receiving the airflow passing through from the printing surface of the medium to the back surface of the medium;

wherein a back side component is provided at a side of the back surface of the medium and includes a hollow portion with an opening that opens towards the back surface of the medium;

wherein providing airflow to the medium with the ink drops includes providing airflow through a main airflow blowing port for blowing a main airflow and at least one sub airflow blowing port for blowing a sub airflow, the sub airflow blowing port being adjacent to the main airflow blowing port, the sub airflow being configured to stream along the main airflow and keep the main airflow as a laminar flow; and wherein each travel path of the ink drops passes through the main airflow blowing port.

12. The ink jet printing method according to claim 11, wherein providing airflow to the medium with the ink drops includes providing airflow through at least one different sub airflow blowing port directly adjacent to the at least one sub airflow blowing port.

13. The ink jet printing method according to claim 11, wherein the main airflow blowing port and the at least one sub airflow blowing port have different shaped openings.

14. The ink jet printing method according to claim 11, wherein providing airflow to the medium with the ink drops further includes providing airflow through at least one different sub airflow blowing port, wherein the at least one different sub airflow blowing port is directly adjacent to the main airflow blowing port on an opposite side thereof with respect to the at least one sub airflow blowing port.

15. The ink jet printing method according to claim 11, wherein providing airflow through a main airflow blowing port includes providing airflow on two opposite sides of each travel path of the ink drops.

* * * * *